US008574010B2

(12) United States Patent
Wu

(10) Patent No.: US 8,574,010 B2
(45) Date of Patent: Nov. 5, 2013

(54) FLEXIBLE SOCKET OF A POWER SOURCE HUB

(75) Inventor: Chiou-Yih Wu, Taipei (TW)

(73) Assignee: Rigous Corporation, Ltd., Taipei (TW)

( * ) Notice: Subject to any disclaimer, the term of this patent is extended or adjusted under 35 U.S.C. 154(b) by 27 days.

(21) Appl. No.: 13/446,233

(22) Filed: Apr. 13, 2012

(65) Prior Publication Data

US 2012/0264328 A1 Oct. 18, 2012

(30) Foreign Application Priority Data

Apr. 15, 2011 (TW) ..... 100113154 A

(51) Int. Cl.
*H01R 33/00* (2006.01)

(52) U.S. Cl.
USPC ..... 439/654; 439/160; 439/447

(58) Field of Classification Search
USPC ..... 439/106, 606, 599, 696, 695, 596, 654, 439/650, 652, 160, 447, 468
See application file for complete search history.

(56) References Cited

U.S. PATENT DOCUMENTS 2,465,419 A * 3/1949 Barany ..... 439/284
3,801,757 A * 4/1974 Carissimi et al. ..... 200/50.28
4,154,499 A * 5/1979 Weber ..... 439/654
5,793,352 A * 8/1998 Greenberg et al. ..... 345/699
5,906,517 A * 5/1999 Crane et al. ..... 439/654
6,179,665 B1 * 1/2001 Rossman et al. ..... 439/654
6,329,616 B1 * 12/2001 Lee ..... 200/51.03
6,642,450 B1 * 11/2003 Hsiao ..... 174/53
6,939,161 B1 * 9/2005 Yi et al. ..... 439/373
7,112,097 B1 * 9/2006 Lam ..... 439/654
7,229,302 B1 * 6/2007 Lai ..... 439/214
7,232,330 B2 * 6/2007 Woellner et al. ..... 439/371
7,534,136 B2 * 5/2009 Bova ..... 439/537
7,540,748 B2 * 6/2009 Tracy et al. ..... 439/131
7,658,625 B2 * 2/2010 Jubelirer et al. ..... 439/131
8,217,528 B2 * 7/2012 Fleisig ..... 307/11
2002/0064983 A1 * 5/2002 Patey ..... 439/152
2005/0221629 A1 * 10/2005 Woellner et al. ..... 439/10
2006/0264087 A1 * 11/2006 Woellner et al. ..... 439/371
2007/0273298 A1 11/2007 Wu
2008/0299811 A1 * 12/2008 Battista ..... 439/345

* cited by examiner

*Primary Examiner* — Neil Abrams
*Assistant Examiner* — Phuongchi T Nguyen
(74) *Attorney, Agent, or Firm* — Bacon & Thomas, PLLC

(57) ABSTRACT

A flexible socket of a power source hub is provided. The input terminal of the hub is electrically connected with a power source. The hub distributes the power source into a plurality of output terminals including first electrodes, second electrodes and ground electrodes. A plurality of sockets extend out from the output terminals via 3-strand cables. Each socket includes three holes corresponding to the first electrode, the second electrode, and the ground electrode. The three-hole sockets are designed to open in a first direction. The strands of the 3-strand cable are arranged one on top of the other in the first direction and extended outside the hub in a second direction substantially perpendicular to the first direction. In this way, it is easy to bend and displace sockets sideways to facilitate the plug-in of the plugs.

4 Claims, 4 Drawing Sheets

FLEXIBLE SOCKET OF A POWER SOURCE HUB

BACKGROUND OF THE INVENTION

1. Field of the Invention

The present invention relates to a multihole socket of a power extension cord, and particularly, to a flexible socket of a power source hub for a power extension cord, in which the sockets can be easily displaced so as to facilitate the plug-in of plugs of electrical appliances.

2. Description of the Related Art

Nowadays, the number of household electrical appliances becomes more and more, and the number of sockets for use is often limited. In particular, a great number of sockets are needed for a computer and its peripherals. In general, a power extension cord having a plurality of multihole sockets is used to fulfill the need. However, such a power extension cord is defective in that when, for example, an adapter or a battery charger is plugged in one of the sockets, its neighboring sockets cannot be used as the holes of the sockets are often blocked or covered by a portion of the adapter or battery charger. It may be convenient to use the power extension cord, but hazardous situations might happen if care is not taken during the use. In particular, the sockets of the extension cord with small wire diameter are almost unable to cope with high-power consumption appliances and the full load thereof. Users are always subject to potential danger.

In order to overcome the disadvantage of the sockets of the conventional extension cord, for example, as shown in FIGS. 1 and 2, the Applicant, in Taiwan patent publication No. 200744267 (corresponding to US patent publication No. 2007/0273298 A1) proposed a multihole socket of a power extension cord, wherein the sockets may be moved with respect to each other due to the flexible cables of the sockets. Although the invention as disclosed in the above-mentioned patent publication may provide improvement over the conventional power extension cord, it is found that it is not easy to bend the flexible cable to displace during use. Particularly, the cable with strands having a wire diameter of over 1.10 $mm^2$ has a comparatively high rigidity, and it is not easy to temporarily displace the sockets. As shown in the cross sectional view of FIG. 2, each socket mainly comprises a cable formed of three strands. In a free state, the three strands of the cable are substantially formed in a triangular arrangement, and the outer layer thereof is wrapped with a P.V.C. material. Therefore, whichever direction the cable is bent, an interference will exist between the three-strands cable and the wrapping material. In terms of physical property, the radius of curvature at the inside part of the bent cable and wrapping material is small, and the radius of curvature at the outside part of the bent cable and wrapping material is large. In a state that the cable and wrapping material are not expandable in whichever directions, it is, of course, difficult to bend. There is still a room for improvement in this respect.

SUMMARY OF THE INVENTION

The main object of the present invention is to provide a flexible socket of a power source hub for improving the disadvantage of the sockets of the conventional power extension cord.

In order to attain the above object and other objects, the flexible socket of the power source hub of the present invention comprises: an extension cord having one end connected to a power source, and the other end extended in a predetermined length and connected to the input terminal of the hub, the hub being designed to distribute the power source into a plurality of output terminals including first electrodes, second electrodes and ground electrodes; a plurality of sockets, extended out from the output terminals via a plurality of 3-strand cables, respectively, wherein each socket includes 3 holes corresponding to the first electrode, the second electrode, and the ground electrode, respectively, and the three-hole sockets are opened in a first direction; the three strands of each cable are arranged to extend externally of the hub in a second direction substantially perpendicular to the first direction, and are disposed in a stacked fashion in a plane parallel to the first direction. In this way, it is easy to bend and displace sockets to the right and the left to facilitate the plug-in of plugs of electric appliances.

According to a further aspect of the present invention, a plug pulling-out device is provided. The device comprises a lever which is pivotally mounted on the socket. One end of the lever is formed of a raise arm which is extended toward the inside of the socket and located between the holes corresponding to the first electrode and the second electrode. The other end of the lever is formed of a press handle which is extended to the outside of the socket to be a point of application. When the press handle is pressed, the raise arm is raised up to facilitate the separation of a plug from the socket with labor-saving. This is another object of the present invention.

DESCRIPTION OF THE PREFERRED EMBODIMENTS

The technical features of the present invention are further described in cooperation with an embodiment. The embodiment is only a representative example and is not used to limit the scope of the present invention. A better understanding can be made with reference to the accompanying drawings together with the following detailed description.

Figure 1:
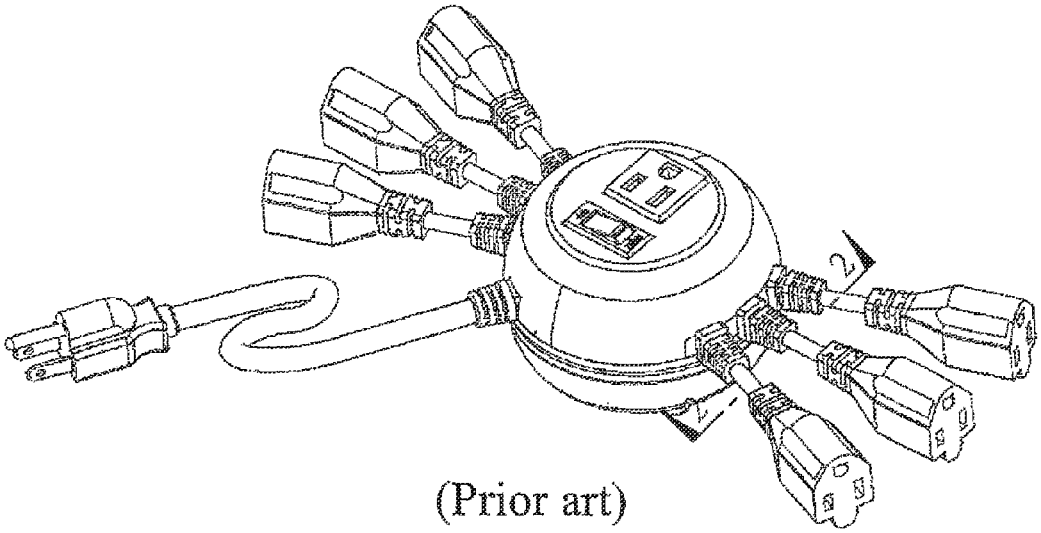
(Prior art) Fig. 1
FIG. 1 is a perspective view showing a hub and sockets for a power extension line of the prior art.
Figure 2:
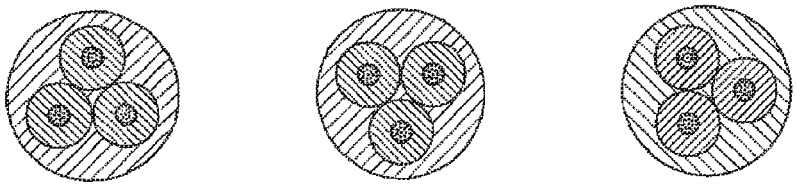
(Prior art) Fig. 2
FIG. 2 is a cross-sectional schematic view taken along line 2-2 of FIG. 1.
Figure 3:
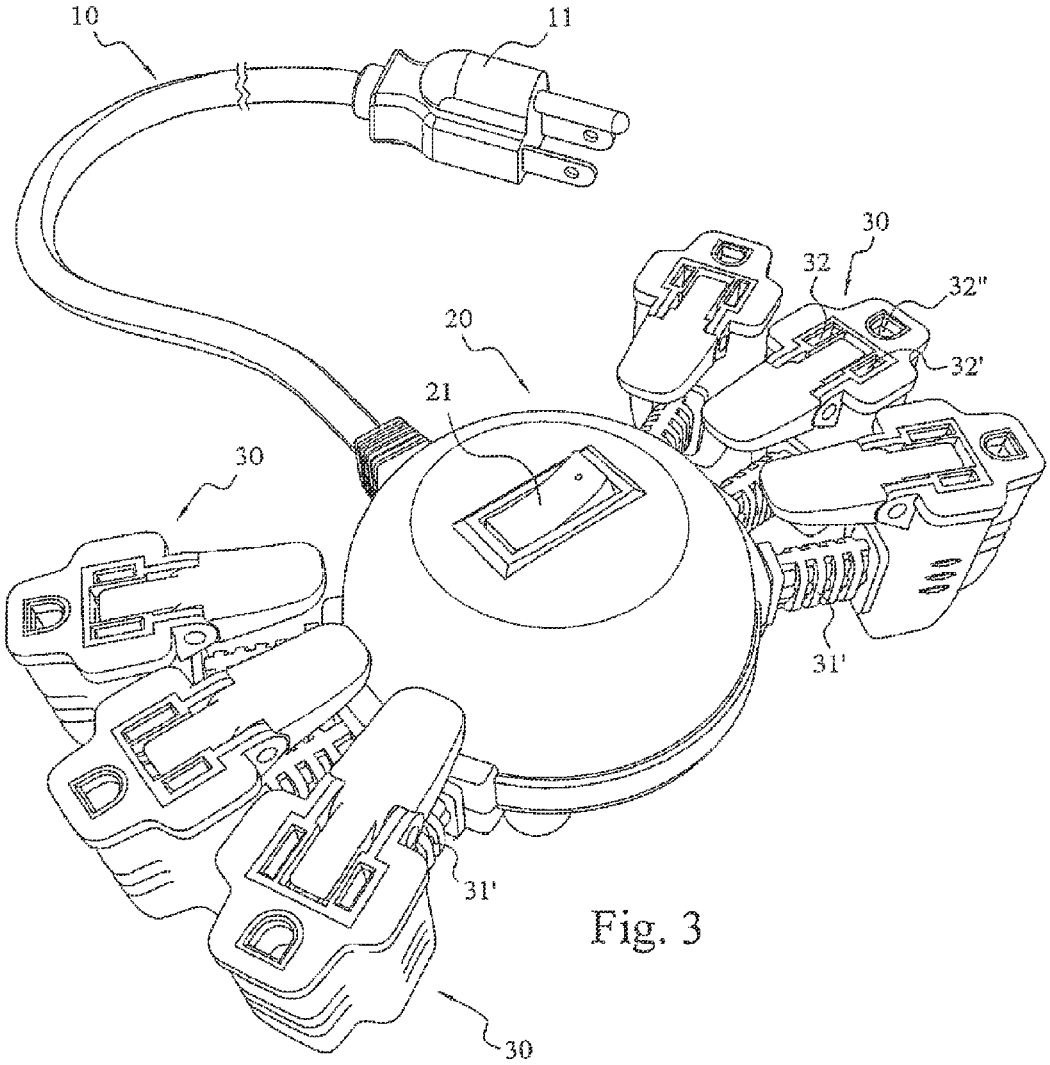
FIG. 3 is a perspective view showing a flexible socket of a power source hub of the present invention.
Figure 4:
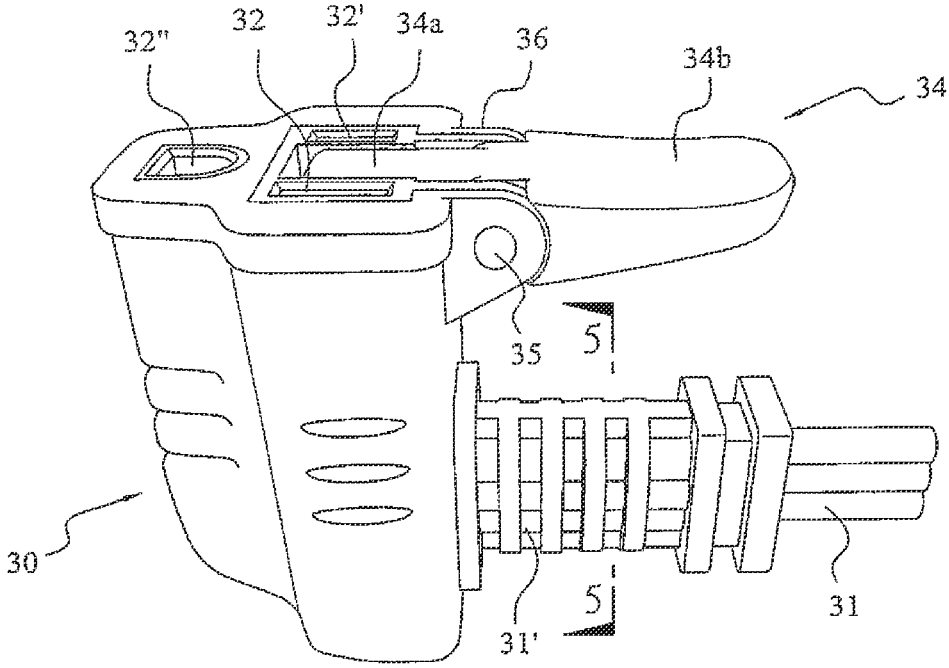
FIG. 4 is a perspective view showing the flexible socket of the present invention in a disconnection state.

First, referring to FIGS. 3 and 4, according to a flexible socket of a power source hub, the input terminal of the hub 20 is electrically connected with a power source. The hub distributes the power source into a plurality of output terminals including first electrodes, second electrodes and ground electrodes. A plurality of 3-strand cables 31 are provided with one end of the respective strands of the cable connected with the first electrode, the second electrode, and the ground electrode of the output terminal of the hub, respectively. The cables 31 extend outside the hub 20. A plurality of 3-hole sockets 30 are further provided with the terminals of each socket connected with the other ends of a corresponding 3-strand cable 31. Each socket 30 includes three holes 32, 32', and 32" corresponding to the first electrode, the second electrode, and the ground electrode, and the holes are opened in a first direction. The respective strands of the 3-strand cable 31 are arranged one on top of the other in the first direction and extend outside the hub 20 in a second direction substantially perpendicular to the first direction. According to the present invention, the input terminal of the hub 20 can be electrically connected with a power source directly via a plug 11, or the input terminal of the hub 20 can be extended outside the hub 20 with an extension line 10 having a predetermined length to be electrically connected with a remote power source. Furthermore, it is conceivable that long cables 31 may be arranged to dispose alternately with short cables 31, so that the sockets are positioned in a staggered fashion (not shown).

Figure 5:
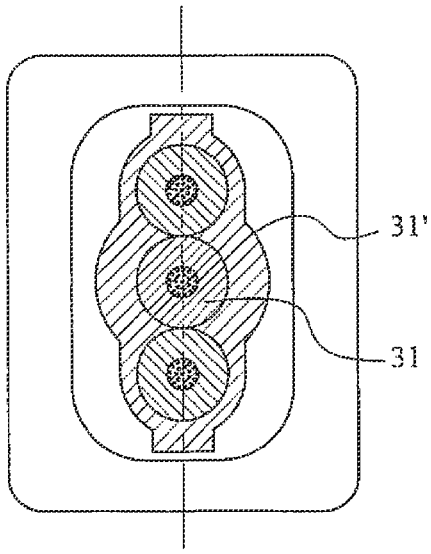
FIG. 5 is a cross-sectional schematic view taken along line 5-5 of FIG. 4.

According to the present invention, preferably, the hub 20 is oblate in shape, and the cables 31 of the sockets 30 radially and horizontally extend outwards from the periphery of the hub 20. Preferably, a switch device 21 is provided on the hub 20 to selectively disconnect or connect the power of the sockets 30. And, under the consideration of safety regulation, each strand of the 3-strand cable 31 for each socket 30 has a section area of at least 1.10 $mm^2$, and like the conventional cable, the outside of the 3-strand cable is wrapped with a P.V.C. material and molded with concave-convex ribs to form a flexible section 31'. As shown in FIG. 5, the respective strands of the 3-strand cable 31 are arranged one on top of the other in the first direction and are in alignment with one another. The width of the flexible section 31' in cross-section is just slightly larger than the wire diameter of a single cable. Therefore, it is easy to displace the sockets 30 sideways to facilitate the plug-in of plugs of electric appliances.

Figure 6:
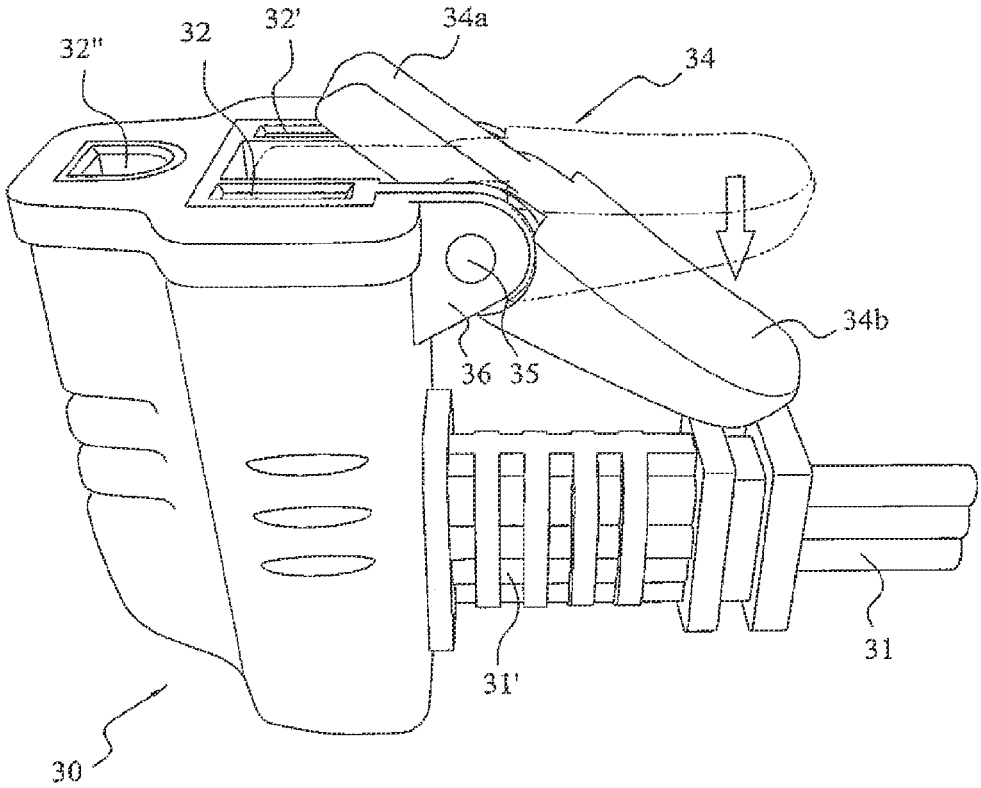
FIG. 6 is a perspective schematic view showing the use state of the flexible socket of present invention.

Moreover, as shown in FIG. 6, the socket 30 of the present invention is designed with a plug pulling-out device 34 which can release the plug of an electric appliance in a labor-saving manner. The plug pulling-out device 34 includes a lever, which is pivotally mounted on a pair of ear parts 36 located at the top part of the socket via an axle pin 35. One end of the lever is formed of a raise arm 34*a* which is extended toward the inside of the socket and located between the holes 32 and 32' corresponding to the first electrode and the second electrode, and is flush with the top surface of the socket 30. The other end of the lever is formed of a press handle 34*b* which is extended to the outside of the socket 30 to act as a point of application. When the press handle 34*b* is pressed, the raise arm 34*a* of the other end is raised up by lever action. At the same time, the plug of the appliance is moved upward to facilitate the disconnection of the plug from the socket 30.

The above-mentioned embodiment is just a representative description of the present invention, and is not used to limit the practice scope of the present invention. Equivalent changes and modifications made without departing from the scope of the claims of the present invention should still fall within the coverage of the present invention.

LIST OF REFERENCE NUMERALS

10 extension line
11 plug
20 hub
21 switch device
30 sockets
31 cable
31' flexible section
32 hole
32' hole
32" hole
34 plug pulling-out device
34*a* raise arm
34*b* press handle
35 axle pin
36 ear parts

What is claimed is:

1. A power source hub, comprising:

an input terminal electrically connected to a power source, a plurality of output terminals electrically connected to the input terminal, and each of the output terminals comprising a first electrode, a second electrode and a ground electrode, a plurality of cables extending externally of the power source hub, each of the cables having three strands connected to the first electrode, second electrode and ground electrode of the output terminal respectively, and a plurality of three-hole sockets electrically connected to the respective cables, wherein the three-hole sockets are configured to open in a first direction, the three strands of each cable being arranged to extend externally of the power source hub in a second direction substantially perpendicular to the first direction and disposed in a stacked fashion in a plane parallel to the first direction; wherein each strand of the cables has a section area of at least 1.10 $mm^2$;

a switch device disposed on the hub to selectively disconnect or connect the power;

wherein each of the sockets includes a pulling-out device for easy removal of a plug in engagement with the socket, the pulling-out device comprises a lever located above the cable and pivotally mounted on the socket, so that the lever is pivotable to exert a force on the plug to aid in disengaging the plug from the socket.

2. The power source hub as claimed in claim 1, further comprising an extension cord having one end connected to the power source through a plug, and the other end connected to the input terminal of the hub.

3. The power source hub as claimed in claim 2, wherein the length of adjoining cables are different from each other such that the three-hole sockets are positioned in a staggered fashion.

4. The power source hub as claimed in claim 2, wherein the hub is oblate in shape, and the cables of the sockets extend radially and horizontally outwards along the periphery of the hub.

* * * * *